United States Patent [19]

Miller, Jr.

[11] 4,367,100

[45] Jan. 4, 1983

[54] SILICON STEEL AND PROCESSING THEREFORE

[75] Inventor: Clarence L. Miller, Jr., Pittsburgh, Pa.

[73] Assignee: Allegheny Ludlum Steel Corporation, Pittsburgh, Pa.

[21] Appl. No.: 85,094

[22] Filed: Oct. 15, 1979

[51] Int. Cl.[3] ..... H01F 1/04

[52] U.S. Cl. ..... 148/113; 148/27; 148/31.5

[58] Field of Search ..... 148/20.6, 27, 31.5, 148/110, 111, 112, 113; 427/127

[56] References Cited

U.S. PATENT DOCUMENTS

| | | | |
|---|---|---|---|
| 3,054,732 | 9/1962 | McQuade | 148/113 |
| 3,076,160 | 1/1963 | Daniels | 148/113 |
| 3,132,056 | 5/1964 | McQuade | 148/31.5 |
| 3,151,000 | 9/1964 | Schmidt | 148/113 |
| 3,151,997 | 10/1964 | Harvey | 148/113 |
| 3,152,930 | 10/1964 | Foster | 148/113 |
| 3,282,747 | 11/1966 | Foster | 148/113 |
| 3,375,144 | 3/1968 | Taylor | 148/113 |
| 3,523,837 | 8/1970 | Paulik | 148/113 |
| 3,523,881 | 8/1970 | Hirst | 148/13.1 |
| 3,676,227 | 7/1972 | Matsumoto et al. | 148/113 |
| 3,785,882 | 1/1974 | Jackson | 148/113 |
| 3,832,245 | 8/1974 | Akerblom | 148/113 |
| 3,932,235 | 1/1976 | Foster | 148/113 |
| 3,941,623 | 3/1976 | Takashiba et al. | 148/113 |
| 4,010,050 | 3/1977 | Choby | 148/113 |
| 4,102,713 | 7/1978 | Shilling et al. | 148/31.5 |
| 4,160,681 | 7/1979 | Miller | 148/113 |
| 4,171,994 | 10/1979 | Miller | 148/111 |
| 4,179,315 | 12/1979 | Miller | 148/113 |

*Primary Examiner*—John P. Sheehan

*Attorney, Agent, or Firm*—Patrick J. Viccaro

[57] ABSTRACT

A process for producing grain oriented electromagnetic silicon steel. The process includes the steps of: preparing a melt of silicon steel having, by weight, from 2.5 to 4.0% silicon; casting the steel; hot rolling the steel; cold rolling the steel; decarburizing the steel; applying a substantially non-reactive aluminum hydroxide coating to the steel; and final texture annealing the steel. The annealed steel being characterized by a substantially uniform metallic surface.

6 Claims, No Drawings

SILICON STEEL AND PROCESSING THEREFORE

The present invention relates to an improvement in the manufacture of grain-oriented silicon steel.

One of the steps in the manufacture of grain oriented silicon steel is the application of a coating prior to final texture annealing. The coating serves to separate and keep adjacent layers of coiled steel from adhering, and in certain instances as an aid in impurity removal and/or as a source of a beneficial inhibitor. The most widely accepted coatings are those which contain magnesium oxide as the major constituent. Magnesium oxide forms a glass on reaction with the steel, resulting in a coating known as forsterite.

Through the present invention there is provided a coating which does not react with the steel and thereby form a glass. A coating which has been found to improve the magnetic quality of the steel. Additionally, a coating which results, after texture annealing in a uniform surface suitable for coatings which may be applied subsequent thereto. The coating contains aluminum hydroxide as the major constituent.

Many references disclose coatings for silicon steel. They include the following U.S. Pat. Nos.:

3,054,732
3,076,160
3,132,056
3,151,000
3,151,997
3,152,930
3,282,747
3,375,144
3,523,837
3,523,881
3,676,227
3,785,882
3,832,245
3,932,235
3,941,623
4,010,050
4,102,713
4,160,681

Although some of them refer to aluminum hydroxide, none of them disclose a coating wherein aluminum hydroxide is the major constituent. Those referring to aluminum hydroxide include: U.S. Pat. Nos.:

3,054,732
3,151,997
3,832,245
4,010,050
4,102,713
4,160,681

Others within said group refer to alumina. Alumina is difficult to apply and, accordingly, unsatisfactory. Heavy particles drop out of solution. References referring to alumina include: U.S. Pat. Nos.:

3,076,160
3,132,056
3,151,000
3,152,930
3,282,747
3,523,837
3,523,881
3,676,227
3,785,882
3,932,235
3,941,623

It is accordingly an object of the present invention to provide an improvement in the manufacture of grain oriented silicon steel.

In accordance with the subject invention, a melt of silicon steel having, by weight, from 2.5 to 4.0% silicon is subjected to the conventional steps of casting, hot rolling, one or more cold rollings, an intermediate anneal when two or more cold rollings are employed, decarburizing, coating and final texture annealing; and to the improvement comprising the steps of applying a coating consisting essentially of:

(a) 100 parts, by weight, of aluminum hydroxide;
(b) up to 20 parts, by weight, of impurity removing additions; and
(c) up to 10 parts, by weight, of inhibiting substances;

and final texture annealing the steel with the coating thereon. For purposes of definitiion, "one part" equals the total weight of (a) hereinabove, divided by 100.

Specific processing as to the conventional steps is not critical and can be in accordance with that specified in any number of publications including the patents referred to hereinabove. The term casting is intended to include continuous casting processes. A hot rolled band heat treatment is includable within the scope of the invention. It is preferred to cold roll the steel to a thickness no greater than 0.020 inch, without an intermediate anneal between cold rolling passes, from a hot rolled band having at thickness of from about 0.050 to 0.120 inch. In most instances, the melt consists essentially of, by weight, up to 0.07% carbon, up to 0.24% manganese, up to 0.09% of material from the group consisting of sulfur and selenium, up to 0.0080% boron, up to 0.02% nitrogen, 2.5 to 4.0% silicon, up to 1.0% copper, up to 0.05% aluminum, up to 0.1% tin, balance iron. Melts consisting essentially of, by weight, 0.02 to 0.06% carbon, 0.015 to 0.15% manganese, 0.005 to 0.05% of material from the group consisting of sulfur and selenium, 0.0006 to 0.0080% boron, up to 0.01% nitrogen, 2.5 to 4.0% silicon, up to 1.0% copper, up to 0.009% aluminum, up to 0.1% tin, balance iron, have proven to be particularly adaptable to the subject invention. Within the latter chemistry, boron is generally present in amounts of at least 0.0008%.

Steel coated and texture annealed in accordance with the subject invention is characterized by improved magnetic quality and by a substantially uniform metallic surface substantially free of glass reaction products. Aluminum hydroxide does not react with silicon steel as does magnesium oxide and other conventional coatings. Aluminum hydroxide does not react and form a glass during texture annealing.

Aluminum hydroxide is generally present in the coating in amounts of a least 80%, and preferably in amounts of at least 90%. The specific amount, being required to ensure a texture annealed steel having a substantially uniform metallic surface substantially free of glass reaction products, being dependent upon the other constituents of the coating. The other constituents include up to 20 parts, by weight, of impurity removing additions and up to 10 parts, by weight, of inhibiting substances. Impurity removing additions can be substances, e.g. magnesia, which react with impurities such as sulfur and selenium, or substances, e.g. alumina, which hold adjacent layers of steel apart thereby allowing hydrogen (present in the annealing atmosphere) access to the steel. Their presence is preferably restricted to less than 10 parts, by weight. Typical inhibiting substances are boron and nitrogen. Boron has proven to be particularly adaptable to the subject invention. In a particular embodiment the coating contains from 1 to 5 parts, by weight, of substances from the group consisting of boron and compounds thereof. Sources of boron include boric acid, fused boric acid ($B_2O_3$), ammonium pentaborate and sodium borate.

The specific mode of applying the coating of the subject invention is not critical thereto. It is just as much within the scope of the subject invention to mix the coating with water and apply it as a slurry, as it is to apply it electrolytically. Likewise, the constituents which make up the coating can be applied together or as individual layers.

Also included as part of the subject invention is the steel in its primary recrystallized state with the coating of the subject invention adhered thereto. The primary recrystallized steel has a thickness no greater than 0.020 inch and is, in accordance with the present invention suitable for processing into grain oriented silicon steel.

The following examples are illustrative of several aspects of the invention.

Two heats (Heats A and B) of silicon steel were cast and processed into silicon having a cube-on-edge orientation. The subject invention has proven to be particularly adaptable to steel of such an orientation. The chemistry for each of the heats appears hereinbelow in Table I.

TABLE I

| Heat | C | Mn | S | B | N | Si | Cu | Al | Sn | Fe |
|---|---|---|---|---|---|---|---|---|---|---|
| A. | 0.031 | 0.032 | 0.02 | 0.0011 | 0.0047 | 3.15 | 0.32 | 0.004 | 0.013 | Bal. |
| B. | 0.030 | 0.035 | 0.02 | 0.0013 | 0.0046 | 3.15 | 0.34 | 0.004 | 0.013 | Bal. |

Processing for the heats involved soaking at an elevated temperature for several hours, hot rolling to a nominal gage of 0.080 inch, hot roll band normalizing at a temperature of approximately 1740° F., cold rolling to final gage, decarburizing at a temperature of approximately 1475° F., coating as described hereinbelow, and final texture annealing at a maximum temperature of 2150° F. in hydrogen. Primary recrystallization took place during the decarburizing heat treatment.

Three coating mixes were prepared. Each coating mix was applied to one sample from each heat. The makeup of the coating mixes appears hereinbelow in Table II.

TABLE II

| Mix | MgO (Parts, by wt.) | $Al(OH)_3$ (parts, by wt.) | $H_3BO_3$ (parts, by wt.) |
|---|---|---|---|
| 1. | 100 | 0 | 0 |
| 2. | 0 | 100 | 0 |
| 3. | 0 | 100 | 2 |

The samples were tested for permeability and core loss. The results of the tests appear hereinbelow in Table III.

TABLE III

| | HEAT | | | |
|---|---|---|---|---|
| | A. | | B. | |
| Mix | Permeability (at 10 $O_e$) | Core Loss (WPP at 17KB) | Permeability (at 10 $O_e$) | Core Loss (WPP at 17KB) |
| 1. | 1900 | 0.737 | 1882 | 0.718 |
| 2. | 1894 | 0.633 | 1882 | 0.649 |
| 3. | 1921 | 0.636 | 1909 | 0.641 |

The benefit of the coating of the subject invention is clearly evident from Tables II and III. The core losses for Heats A and B respectively dropped to values of 0.633 and 0.649 from respective values of 0.737 and 0.718 when the mix changed from 100 parts MgO to 100 parts $Al(OH)_3$. Core losses were respectively, and very significantly, reduced 14.1 and 9.3%. Further improvements were also detectable with boron additions to the $Al(OH)_3$ mix.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. In a process for producing grain oriented electromagnetic silicon steel, which process includes the steps of: preparing a melt of silicon steel having, by weight, from 2.5 to 4% silicon; casting said steel; hot rolling said steel; cold rolling said steel; decarburizing said steel; coating said steel and final texture annealing said steel; the improvement comprising the steps of applying a coating consisting essentially of:

(a) 100 parts, by weight, of aluminum hydroxide;

(b) magnesium oxide present in minor amounts of up to 20 parts, by weight, for reacting with impurities; and (c) up to 10 parts, by weight, of inhibiting substances; and final texture annealing said steel with said coating thereon, said annealed steel having a substantially uniform metallic surface substantially free of glass reaction products.

2. The improvement according to claim 1, wherein said coating is at least 80% aluminum hydroxide.

3. The improvement according to claim 2, wherein said coating is at least 90% aluminum hydroxide.

4. The improvement according to claim 1, wherein said coating has less than 10 parts, by weight, of magnesium hydroxide.

5. The improvement according to claim 1, wherein said coating has from 1 to 5 parts, by weight, of substances from the group consisting of boron and compounds thereof.

6. Grain oriented electromagnetic silicon steel characterized by a substantially uniform metallic surface and made in accordance with the process of claim 1.

* * * * *